US008696092B2

(12) United States Patent
Gao et al.

(10) Patent No.: US 8,696,092 B2
(45) Date of Patent: Apr. 15, 2014

(54) LIQUID DISPENSER INCLUDING ACTIVE MEMBRANE ACTUATOR

(75) Inventors: Zhanjun Gao, Rochester, NY (US); Yonglin Xie, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/552,743

(22) Filed: Jul. 19, 2012

(65) Prior Publication Data

US 2014/0022307 A1 Jan. 23, 2014

(51) Int. Cl.
*B41J 2/05* (2006.01)

(52) U.S. Cl.
USPC ..... 347/65; 347/67

(58) Field of Classification Search
None
See application file for complete search history.

(56) References Cited

U.S. PATENT DOCUMENTS

| | | | | |
|---|---|---|---|---|
| 3,614,677 | A | 10/1971 | Wilfinger | |
| 4,480,259 | A | 10/1984 | Kruger et al. | |
| 6,130,690 | A | 10/2000 | Ahn | |
| 6,312,109 | B1 | 11/2001 | Chen | |
| 6,336,711 | B1 | 1/2002 | Ahn | |
| 6,345,883 | B1 | 2/2002 | Shin et al. | |
| 6,378,991 | B1 | 4/2002 | Lim et al. | |
| 6,431,688 | B1 | 8/2002 | Shin et al. | |
| 6,436,301 | B1 * | 8/2002 | Hiroki et al. | 216/27 |
| 6,705,716 | B2 * | 3/2004 | Mott | 347/94 |

FOREIGN PATENT DOCUMENTS

| | | |
|---|---|---|
| EP | 0 845 358 | 6/1998 |
| EP | 0 882 592 | 9/2005 |

OTHER PUBLICATIONS

Scheeper et al., "The Design, Fabrication, and Testing of Corrugated Silicon Nitride Diaphragms", *Journal of Microelectromechanical Systems*, vol. 3, No. 1, Mar. 1994, pp. 36-42.

* cited by examiner

*Primary Examiner* — Geoffrey Mruk
(74) *Attorney, Agent, or Firm* — William R. Zimmerli

(57) ABSTRACT

A liquid dispenser includes a first liquid chamber and a second liquid chamber. The first liquid chamber includes a nozzle. The second chamber is in fluid communication with a liquid supply channel and a liquid return channel. A flexible membrane is positioned to separate and fluidically seal the first liquid chamber and the second liquid chamber from each other. The flexible membrane includes a bimorph actuator that causes the flexible membrane to move from a first position to a second position to eject liquid through the nozzle of the first liquid chamber. In one example embodiment, a liquid supply provides a liquid that flows continuously from the liquid supply through the liquid supply channel through the second liquid chamber through the liquid return channel and back to the liquid supply during a drop dispensing operation.

10 Claims, 4 Drawing Sheets

(c)

LIQUID DISPENSER INCLUDING ACTIVE MEMBRANE ACTUATOR

CROSS REFERENCE TO RELATED APPLICATIONS

Reference is made to commonly-assigned, U.S. patent application Ser. No. 13/552,752, entitled "LIQUID DISPENSER INCLUDING PASSIVE PRE-STRESSED FLEXIBLE MEMBRANE", Ser. No. 13/552,763, entitled "LIQUID DISPENSER INCLUDING ASYMMETRIC NOZZLE ACTUATOR CONFIGURATION", all filed concurrently herewith.

FIELD OF THE INVENTION

This invention relates generally to the field of digitally controlled liquid dispensing devices and, in particular, to liquid dispensing devices that include a flexible membrane.

BACKGROUND OF THE INVENTION

Ink jet printing has become recognized as a prominent contender in the digitally controlled, electronic printing arena because of its non-impact, low-noise characteristics, its use of plain paper, and its avoidance of toner transfer and fixing. Ink jet printing mechanisms can be categorized by technology as either drop on demand ink jet (DOD) or continuous ink jet (CIJ).

Continuous inkjet printing uses a pressurized liquid source that produces a stream of drops some of which are selected to contact a print media (often referred to a "print drops") while other are selected to be collected and either recycled or discarded (often referred to as "non-print drops"). For example, when no print is desired, the drops are deflected into a capturing mechanism (commonly referred to as a catcher, interceptor, or gutter) and either recycled or discarded. When printing is desired, the drops are not deflected and allowed to strike a print media. Alternatively, deflected drops can be allowed to strike the print media, while non-deflected drops are collected in the capturing mechanism.

Drop on demand printing only provides drops (often referred to a "print drops") for impact upon a print media. Selective activation of an actuator causes the formation and ejection of a drop that strikes the print media. The formation of printed images is achieved by controlling the individual formation of drops. Typically, one of two types of actuators is used in drop on demand printing devices—heat actuators and piezoelectric actuators. When a piezoelectric actuator is used, an electric field is applied to a piezoelectric material possessing properties causing a wall of a liquid chamber adjacent to a nozzle to be displaced, thereby producing a pumping action that causes an ink droplet to be expelled. When a heat actuator is used, a heater, placed at a convenient location adjacent to the nozzle, heats the ink. Typically, this causes a quantity of ink to phase change into a gaseous steam bubble that displaces the ink in the ink chamber sufficiently for an ink droplet to be expelled through a nozzle of the ink chamber.

In some applications it may be desirable to use an ink that is not aqueous and, as such, does not easily form a vapor bubble under the action of the heater. Heating some inks may cause deterioration of the ink properties, which can cause reliability and quality issues. As described in U.S. Pat. No. 4,480,259 and U.S. Pat. No. 6,705,716, one solution is to have two fluids in the print head with one fluid dedicated to respond to an actuator, for example, to create a vapor bubble upon heating, while the other fluid is the ink. The performance capabilities of these types of print heads is often limited due to the resistance of the membrane or diaphragm that separates the actuator fluid from the ink which reduces the amount of volumetric displacement that occurs in ink chamber as a result of the pressure caused by the vaporization of the actuator fluid.

Although U.S. Pat. No. 4,480,259 and U.S. Pat. No. 6,705,716 both describe flexible diaphragms, it is well understood by one skilled in the art that it is difficult to manufacture a micro-fluidics device such as an ink jet print head using conventional MEMS technology while incorporating a sufficiently elastic material for use as a diaphragm. Additionally, repeated cycles of stretch and relax cause material fatigue in the diaphragm resulting in reduced device reliability and poor device performance.

As such, there is an ongoing effort to increase the reliability and performance of print heads that include two fluids and a flexible membrane.

SUMMARY OF THE INVENTION

According to an aspect of the present invention, a liquid dispenser includes a first liquid chamber and a second liquid chamber. The first liquid chamber includes a nozzle. The second chamber is in fluid communication with a liquid supply channel and a liquid return channel. A flexible membrane is positioned to separate and fluidically seal the first liquid chamber and the second liquid chamber from each other. The flexible membrane includes a bimorph actuator that causes the flexible membrane to move from a first position to a second position to eject liquid through the nozzle of the first liquid chamber. In one example embodiment, a liquid supply provides a liquid that flows continuously from the liquid supply through the liquid supply channel through the second liquid chamber through the liquid return channel and back to the liquid supply during a drop dispensing operation.

According to another aspect of the present invention, a method of printing includes providing a liquid dispenser made in accordance with the invention described herein and using it to dispense liquid drops.

In one example embodiment of the invention, the bimorph actuator of the flexible membrane is a thermal bimorph and the continuously flowing working fluid is non-corrosive and includes sufficient thermal conductivity and heat capacity to cool the thermal bimorph allowing the thermal bimorph to rapidly return to its quiescent state ready for the next actuation cycle. In another example embodiment of the invention, the bimorph actuator is a piezoelectric actuator.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
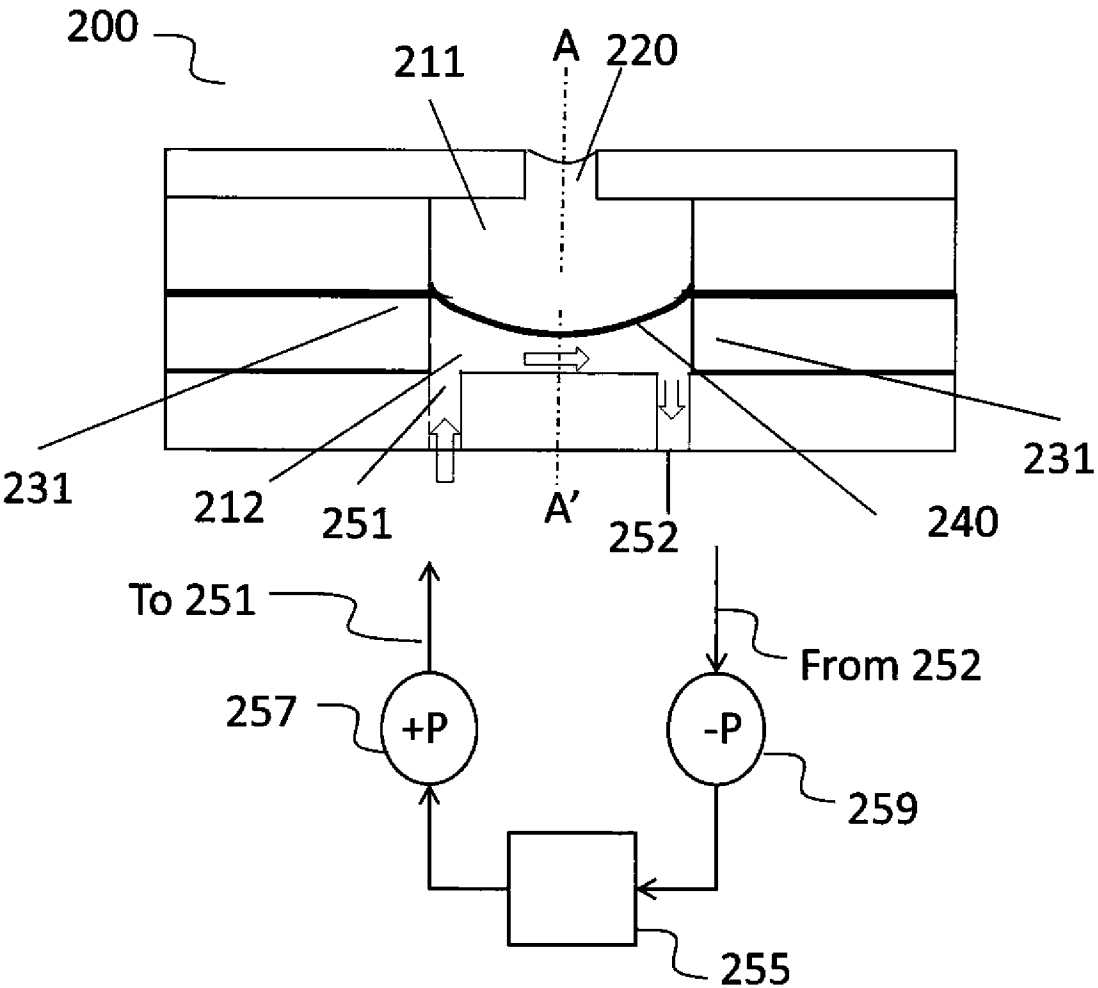
FIG. 1 is a schematic cross sectional view of an example embodiment of a liquid dispenser made in accordance with the present invention.

The present description will be directed in particular to elements forming part of; or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a liquid dispenser, often referred to as a print head, which is particularly useful in digitally controlled inkjet printing devices in which drops of ink are ejected from a print head toward a print medium. However, many other applications are emerging which use liquid dispensers, similar to inkjet print heads, to emit liquids, other than inks, that need to be finely metered and deposited with high spatial precision. As such, as described herein, the terms "liquid" and "ink" are used interchangeably and refer to any material, not just inkjet inks, which can be ejected by the example embodiments of the liquid dispenser described below.

In addition to inkjet printing applications in which the fluid typically includes a colorant for printing an image, the liquid dispenser of the present invention is also advantageously used in ejecting other types of fluidic materials. Such materials include functional materials for fabricating devices (including conductors, resistors, insulators, magnetic materials, and the like), structural materials for forming three-dimensional structures, biological materials, and various chemicals. The liquid dispenser of the present invention provides sufficient force to eject fluids having a higher viscosity than typical inkjet inks, and does not impart excessive heat into the fluids that could damage the fluids or change their properties undesirably.

Referring to FIG. 1, a liquid dispenser 200 including a membrane MEMS actuator is shown. Liquid dispenser 200 includes a first liquid chamber 211 and a second liquid chamber 212. First liquid chamber 211 includes a nozzle 220. A flexible membrane 240 is positioned in liquid dispenser 200 to separate and fluidically seal the first liquid chamber 211 and the second liquid chamber 212. As shown in FIG. 1, flexible membrane 240 bows away from nozzle 220 in an unactuated position or state (often referred to as an at rest position or state). The overall shape of flexible membrane 240 is concave relative to first chamber 211 or convex relative to second chamber 212 when viewed from end to end of flexible membrane 240 along a plane that separates first chamber 211 and second chamber 212 from each other.

In one example embodiment of the invention, flexible membrane 240 includes a selectively actuatable actuator that uses heat energy to divert a portion a liquid (often referred to as a first liquid) located in first liquid chamber 211 through nozzle 220. The thermal actuator uses heat energy to change the position of the actuator relative to a plane that separates first chamber 211 and second chamber 212 from each other. An example of this type of actuator includes a bi-layer thermal micro-actuator described in more detail below with reference to FIGS. 3(*a*)-3(*c*). As shown in FIG. 1, the actuator included in flexible membrane 240 is anchored on both ends of the wall(s) of liquid dispenser 200 that help define first chamber 211 and second chamber 212. As shown in FIG. 1, the actuator of flexible membrane 240 is selectively movable through the plane that separates first chamber 211 and second chamber 212 from each other into and out of first chamber 211 during actuation. In another example embodiment of the invention, flexible membrane 240 includes a selectively actuatable actuator, for example, a bimorph piezoelectric actuator, that uses a piezoelectric effect to divert a portion a liquid (often referred to as a first liquid) located in first liquid chamber 211 through nozzle 220.

A center axis A-A' extends through the center of nozzle 220. Nozzle 220 includes a center point and flexible membrane 240 includes a center point. As shown in FIG. 1, the center points of nozzle 220 and flexible membrane 240 are collinear relative to each other and located on center axis A-A'. The overall shape of flexible membrane 240 is symmetric relative to center axis A-A' when viewed, as shown in FIG. 1, from end to end of flexible membrane 240.

First chamber 211 is adapted to receive a liquid that is supplied to first chamber 211 in a conventional manner. Second chamber 212 is adapted to receive a liquid that is supplied to second chamber 212 in a conventional manner or in a manner according to one aspect of the present invention (described in more detail below). As flexible membrane 240 fluidically seals first chamber 211 and second chamber 212 from each other, first chamber 211 and second chamber 212 are physically distinct from each other which allows the first liquid and the second liquid present in each respective chamber to be different types of liquid when compared to each other in example embodiments of the invention.

Figure 2:
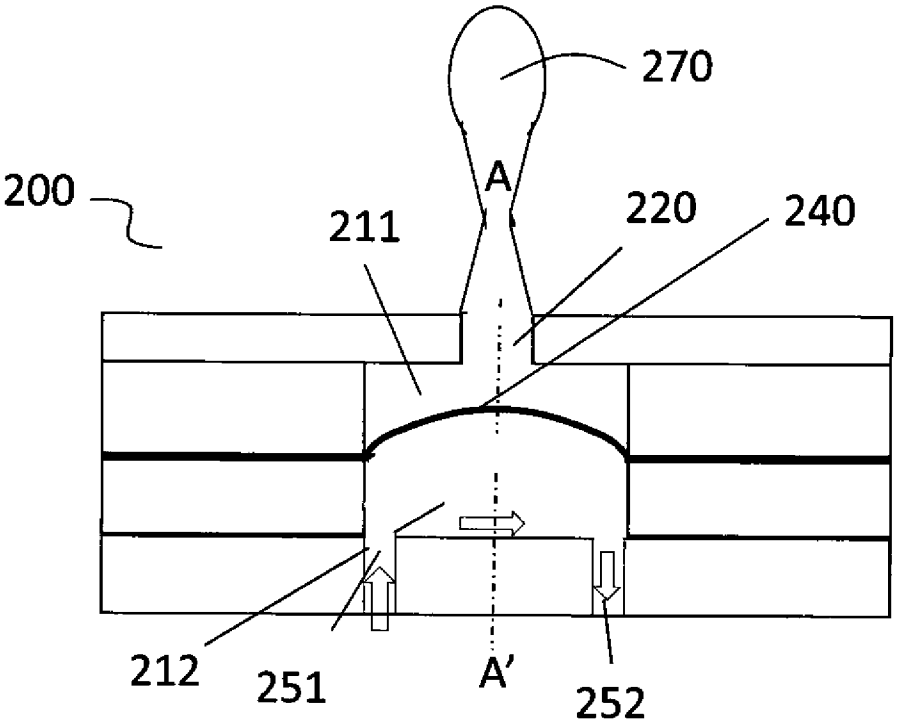
FIG. 2 is a schematic cross sectional view of the example embodiment shown in FIG. 1 in an actuated state.

Referring to FIG. 2, when the actuator, for example, a bimorph thermal or piezoelectric actuator, included in flexible membrane 240 is energized, the displacement of the flexible membrane 240 pressurizes the liquid in the first liquid chamber 211 and ejects a liquid drop 270 through nozzle 220. Flexible membrane 240 is attached to the side wall(s) that help define first chamber 211 or second chamber 212 of liquid dispenser 200 to provide a fluidic seal between first chamber 211 and second chamber 212 and also to provide a mechanical constraint that is critical to the snap-through behavior of the membrane (described in more detail below).

Referring back to FIG. 1 in addition to FIG. 2, liquid dispenser 200 includes a liquid (often referred to as a first liquid) that continuously circulates through second chamber 212 during a drop ejection or dispensing operation. A liquid supply channel 251 is in fluid communication with second chamber 212 and a liquid return channel 252 is in fluid communication with second chamber 212. Liquid supply channel 251 and liquid return channel 252 are also in fluid communication with a liquid supply 255. During a drop ejection or dispensing operation, liquid supply 255 provides a liquid (commonly referred to as a working fluid or liquid or a first liquid) that flows continuously from liquid supply 255 through liquid supply channel 251 through second liquid chamber 212 through liquid return channel 252 and back to liquid supply 255. The circulating working fluid helps to increase the drop ejection frequency by removing at least some of the heat generated by the actuator included in flexible membrane 240 when the actuator is a thermal actuator.

Typically, liquid is supplied to first chamber 211 in a manner similar to liquid chamber refill in a conventional drop on demand device. For example, during a drop dispensing operation using liquid dispenser 200, the liquid is not continuously flowing to first chamber 211 during a drop ejection or dispensing operation. Instead, first chamber 211 is refilled with liquid on an as needed basis that is made necessary by the ejection of a drop of the liquid from first chamber 211 through nozzle 220.

A regulated pressure source 257 is positioned in fluid communication between liquid supply 255 and liquid supply channel 251. Regulated pressure source 257, for example, a pump, provides a positive pressure that is usually above atmospheric pressure. Optionally, a regulated vacuum supply 259, for example, a pump, can be included in order to better control liquid flow through second chamber 212. Typically, regulated vacuum supply 259 is positioned in fluid communication between liquid return channel 252 and liquid supply 255 and provides a vacuum (negative) pressure that is below atmospheric pressure. Liquid supply 255, regulated pressure source 257, and optional regulated vacuum supply 259 can be referred to as the liquid delivery system of liquid dispenser 200.

In one example embodiment, liquid supply 255 applies a positive pressure provided by a positive pressure source 257 at the entrance of liquid supply channel 251 and a negative pressure (or vacuum) provided by a negative pressure source 259 at the exit of liquid return channel 252. This helps to maintain the pressure inside second liquid chamber 212 at substantially the same pressure (for example, ambient pressure conditions) at the exit of nozzle 220 when the actuator is not energized. As a result, flexible membrane 240 is not deflected during a time period of drop dispensing when the actuator is not energized.

As flexible membrane 240 fluidically seals first chamber 211 and second chamber 212 from each other, first chamber 211 and second chamber 212 are physically distinct from each other which allows the first liquid and the second liquid present in each respective chamber to be different types of liquid when compared to each other in example embodiments of the invention. For example, the second liquid can include properties that increase its ability to remove heat while the second liquid can be an ink. The second liquid can include properties that lower its boiling point when compared to first liquid. The second liquid can include properties that make it a non-corrosive liquid, for example, nonionic liquid, in order to improve and maintain the functionality of the actuator or increase its lifetime.

A high degree of flexibility in flexible membrane 240 is preferred to effectively transmit the pressure generated by its actuation to the fluid or liquid of interest (a first liquid), for example, ink, located in first chamber 211. Since flexible membrane 240 includes the selectively activated actuator, an elastic material can be included with a high modulus material during flexible membrane fabrication.

Figure 3:
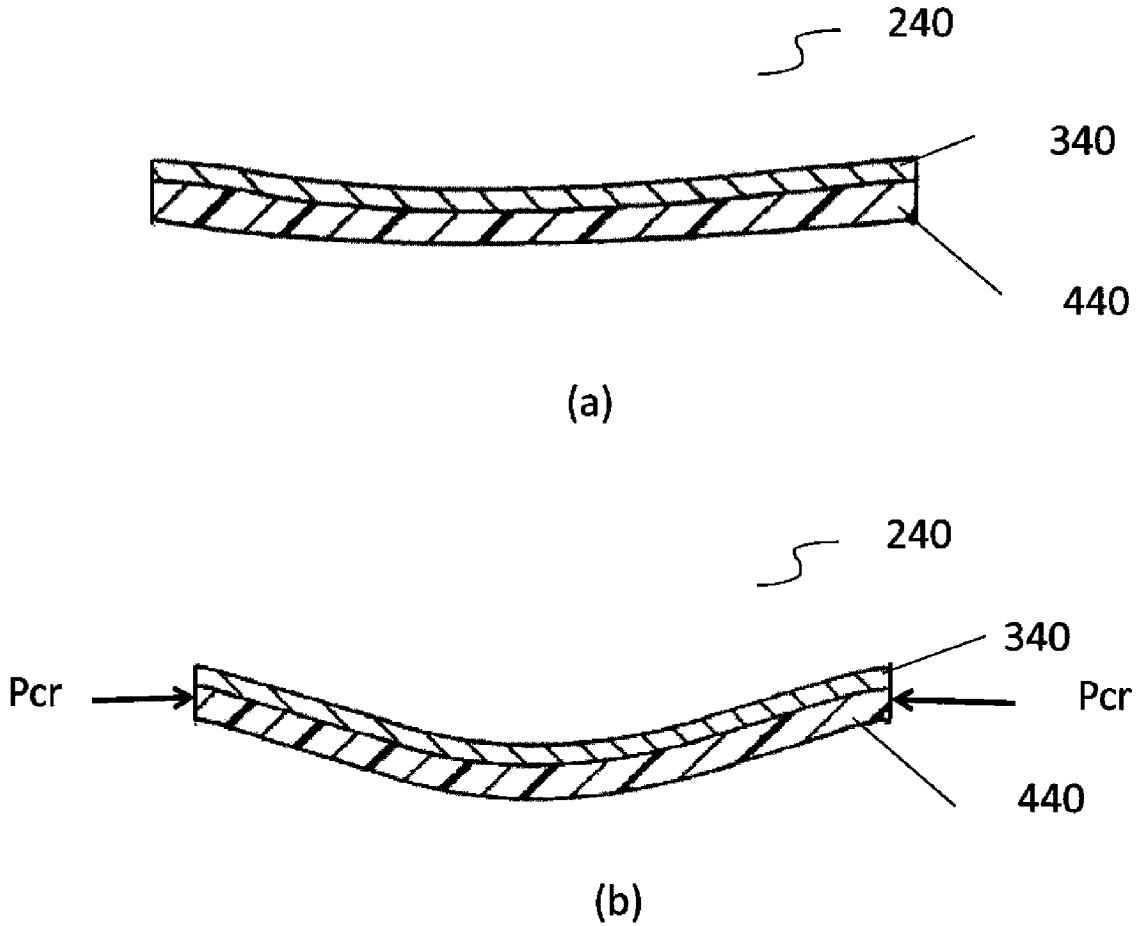
FIGS. 3(*a*)-3(*c*) are schematic cross sectional side views illustrating an example embodiment of a flexible membrane included in an example embodiment of a liquid dispenser made in accordance with the present invention.
Figure 3:
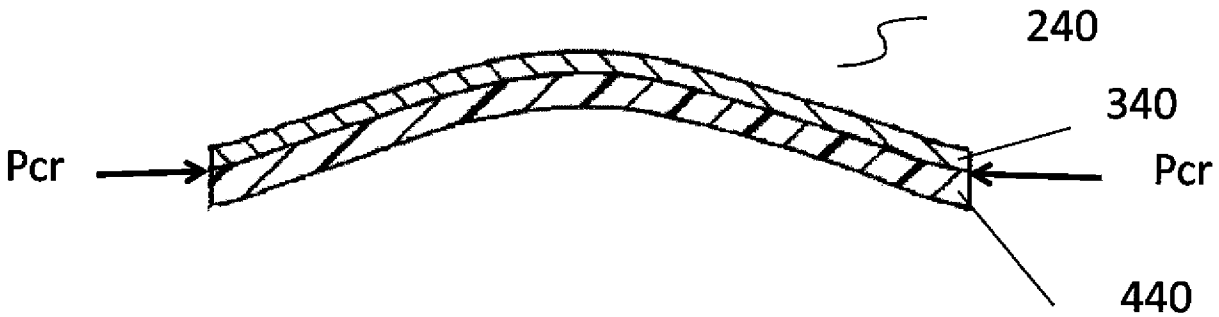

FIGS. 3(*a*)-3(*c*) show details of flexible membrane 240 shown in FIGS. 1 and 2 and illustrate the principle way the present invention functions. As shown in FIGS. 3(*a*)-3(*c*), flexible membrane 240 includes a bimorph thermal actuator. The bimorph actuator includes two layers, a first layer 440 and a second layer 340. First layer 440 includes a material having a low coefficient of thermal expansion, such as a silicon oxide or nitride. Second layer 340 includes a material having a high coefficient of thermal expansion such as a metal. In FIG. 3(*a*), flexible membrane 240 at a free standing position at an ambient temperature. Here, "Free standing" refers to a theoretical analysis where the flexible membrane 240 in FIG. 1 is cut out from the liquid dispenser 200, and let it free stand without any thermal or mechanical constraints. One important feature of the present inventions is that the flexible membrane is slightly bowing away from the second layer 340 as shown in FIG. 3(*a*). This residual shape predisposes the deformable element to bow away from the second layer if the ends of the deformable element are compressed.

FIG. 3(*b*) shows the shape of flexible membrane 240 in the liquid dispenser 200 without the bimorph actuator being activated. Flexible membrane 240 is fabricated in such way to result in residual compressive stress in the flexible membrane at an ambient temperature. Side wall(s) 231 of liquid dispenser 200 provide constraints to the flexible membrane 240 within which the residual compressive stress develops upon cooling down from the manufacturing temperature of the flexible membrane. The compressive stress level should be equal or slightly above the Euler buckling stress, Pcr, of the flexible membrane. The concept of buckling and Euler buckling stress, Pcr, is discussed in many strength of materials or structure mechanics textbooks including, for example, Timoshenko, S. P., and Gere, J. M., Theory of Elastic Stability, 2 ed., McGraw-Hill, 1961. The existence of the compressive stress, Per, in the flexible membrane causes the flexible membrane to bow further away from the second layer 340 as shown in FIG. 3(*b*) when compared to the bow of flexible membrane 240 as shown in FIG. 3(*a*).

Buckling can be analyzed as a mathematical instability. Theoretically, buckling is caused by a bifurcation in the solution to the equations of static equilibrium. At a certain stage under an increasing load, further load is able to be sustained in undeformed state or laterally-deformed states. Bifurcation buckling (Timoshenko and Gere) is sometimes called Euler buckling. As the applied load is beyond the critical load, the structure deforms into a buckled configurations with small amount of force in the lateral directions.

FIG. 3(*c*) illustrates the behavior of flexible membrane 240 when heated. Due to the thermal expansion mismatch between first layer 440 and second layer 340, the thermal stress can cause the beam to make a snap-through transition from one buckled equilibrium position shown in FIG. 3(*b*) to another buckled equilibrium position shown in FIG. 3(*c*). In one example embodiment of the present invention, the residual compressive stress, Pcr, is equal or slightly above the Euler buckling stress. Under such a condition, the flexible membrane can be driven by the thermal bimorph actuator with a low level of lateral force and produce a large deflection.

As the non-flat shape is heated, it expands thermally, bending further downwards in the direction of the residual shape bowing away from second layer 340. The thermal moment, generated by the differences in thermal expansion between first layer 440 and second layer 340, bends the membrane until it snaps-through to buckle toward the opposite side, toward second layer 340. As this happens, the membrane element is significantly compressed, in order to squeeze through the interval in the central plane that is shorter than its rest length. A considerable amount of energy is stored in the compression of the deformable element, energy that is released as kinetic energy when the actuator snaps through and emerges on the opposite side of the central plane. Three elements are important to achieving the snap-through actuation using the thermal actuator of the present invention: non-rigid or semi-rigid connections of the membrane to the side walls, a substantial thermal moment arising from the composition of the deformable element, and a residual shape which is bowed away from the direction in which the thermal moment will force the membrane upon the application of a heat pulse.

Flexible membrane 240 returns to the residual shape illustrated as FIG. 3(*b*) upon cooling. The circulating working fluid, shown in FIGS. 1 and 2, helps to increase the drop ejection frequency by cooling the flexible membrane which includes a thermal bimorph actuator. The liquid can also damp out unwanted oscillation of the bimorph actuator. Flexible membrane 240 is not bistable in that it does not remain in the buckled-up state when allowed to return to the rest temperature which exhibits the slight buckled-down residual shape (as shown in FIGS. 3(*a*)-3(*c*)). The existence of the second fluid will help cool down the bimorph actuator faster to allow higher frequency operation.

Liquid dispenser 200 is typically formed from a semiconductor material (for example, silicon) using semiconductor fabrication techniques (for example, CMOS circuit fabrication techniques, micro-electro mechanical structure (MEMS) fabrication techniques, or a combination of both). Alternatively, liquid dispenser 200 can be formed using conventional materials and fabrication techniques known in the art.

A liquid dispenser array structure made according to the present invention includes a plurality of liquid dispensers 200 described above with reference to FIGS. 1-3(*c*). The plurality of liquid dispensers 200 are formed, for example, integrally formed through a series of material layering and processing steps, on a common substrate typically using the fabrication techniques described above to create a monolithic liquid dispenser structure. When compared to other types of liquid dispensers, monolithic liquid dispenser configurations help to improve the alignment of each nozzle opening relative to other nozzle openings which improves drop deposition accuracy. Monolithic liquid dispenser configurations also help to reduce spacing in between adjacent nozzle openings which can increase the dots per inch (dpi) capability of the device.

The invention has been described in detail with particular reference to certain preferred embodiments thereof, but it will be understood that variations and modifications can be effected within the scope of the invention.

PARTS LIST

200 Liquid dispenser
211 First liquid chamber
212 Second liquid chamber
220 Nozzle
231 Side walls of chamber
240 Flexible membrane
270 Liquid drop
251 Liquid supply channel
252 Liquid return channel
255 liquid supply
257 pressure source
259 pressure source
340 Second layer of bimorph membrane
440 First layer of bimorph membrane

The invention claimed is:

1. A liquid dispenser comprising:
a first liquid chamber including a nozzle;
a second liquid chamber;
a liquid supply channel in fluid communication with the second chamber;
a liquid return channel in fluid communication with the second chamber;
a flexible membrane positioned to separate and fluidically seal the first liquid chamber and the second liquid chamber from each other, the flexible membrane including a bimorph actuator that causes the flexible membrane to move from a first position to a second position to eject liquid through the nozzle of the first liquid chamber; and
a liquid supply that provides a liquid that flows continuously from the liquid supply through the liquid supply channel through the second liquid chamber through the liquid return channel and back to the liquid supply.

2. The liquid dispenser of claim 1, the nozzle including a center axis, the bimorph actuator of the flexible membrane including a center point, wherein the center point of the bimorph of the flexible membrane is located on the center axis of the nozzle.

3. The liquid dispenser of claim 1, the first liquid chamber including a first liquid and the second liquid chamber including a second liquid, wherein the first liquid and the second liquid are different liquids.

4. The liquid of dispenser of claim 3, wherein the second liquid is a non-corrosive liquid.

5. The liquid dispenser of claim 1, wherein the bimorph actuator is a thermal bimorph actuator.

6. The liquid dispenser of claim 5, the first liquid chamber including a first liquid and the second liquid chamber including a second liquid, wherein the first liquid and the second liquid are different liquids.

7. The liquid of dispenser of claim 6, wherein the second liquid has a higher thermal conductivity when compared to the first liquid.

8. The liquid of dispenser of claim 6, wherein the second liquid is a non-corrosive liquid.

9. The liquid dispenser of claim 1, wherein the bimorph actuator is a piezoelectric actuator.

10. The liquid dispenser of claim 1, the flexible membrane that separates and fluidically seals the first liquid chamber and the second liquid chamber from each other including a residual compressive stress that exceeds an onset buckling stress of the flexible membrane such that the flexible membrane is located in the first position, wherein the bimorph actuator is selectively actuated to cause the flexible membrane to move from the first position to the second position to eject liquid through the nozzle of the first liquid chamber.

* * * * *